US008303326B1

(12) United States Patent
McKee

(10) Patent No.: US 8,303,326 B1
(45) Date of Patent: Nov. 6, 2012

(54) CABLE CONNECTOR ASSEMBLY WITH LOCKING MEMBERS WITH SPRING-ACTUATED PLUNGERS

(75) Inventor: Michael McKee, Camp Hill, PA (US)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 0 days.

(21) Appl. No.: 13/189,553

(22) Filed: Jul. 24, 2011

(51) Int. Cl.
*H01R 13/627* (2006.01)

(52) U.S. Cl. ..... 439/358

(58) Field of Classification Search ..... 439/351–358, 439/557, 575
See application file for complete search history.

(56) References Cited

U.S. PATENT DOCUMENTS 6,953,361 B2 * 10/2005 Li et al. ..... 439/358
6,957,976 B2 * 10/2005 Zhang ..... 439/358
6,991,487 B2 * 1/2006 Wu ..... 439/358
7,192,297 B1 * 3/2007 Wu ..... 439/358
7,252,531 B2 * 8/2007 Wu ..... 439/358
7,264,496 B2 * 9/2007 Wu ..... 439/358
7,410,382 B2 * 8/2008 Wu ..... 439/358
7,604,497 B2 * 10/2009 Wu et al. ..... 439/358

* cited by examiner

*Primary Examiner* — Chandrika Prasad
(74) *Attorney, Agent, or Firm* — Wei Te Chung; Ming Chieh Chang

(57) ABSTRACT

A cable connector assembly includes a matable connector and a cable connector intended to mate with the matably connector. The matable connector includes a pair of guiding boats at opposite ends thereof and each guiding boat defines a guiding groove and a locking slot in the guiding groove. The cable connector includes a case, a connector body with a mating port exposing to a front edge of the case and cables running through a rear edge of the case and a pair of locking members located at the case. The connector body defines a pair of guiding posts intended to be communicated in the guiding grooves of the matably connector. Each guiding post defines a first receiving groove therein. Each locking members includes a rear end retained in the case and a front end with a locking end extending forward and received in the first receiving groove.

18 Claims, 9 Drawing Sheets

CABLE CONNECTOR ASSEMBLY WITH LOCKING MEMBERS WITH SPRING-ACTUATED PLUNGERS

BACKGROUND OF THE INVENTION

1. Field of the Invention

The present invention is generally related to an electrical connector assembly adapted for high speed, particularly to a cable connector having locking engagement between the plug connector and a mating connector or receptacle connector.

2. Description of Related Arts

U.S. Pat. No. 6,558,183 illustrates a plug connector includes a casing, a mating portion retained by the casing for mating with a mating connector, a pair of lock members and a pair of release buttons. The lock members are fixed in the casing. The lock members each include a resilient lock arm. A pawl extends from an end of each lock arm for engaging with a corresponding part of the mating connector. The release buttons are separately made and are pivotally mounted in the casing. The release buttons each include an actuating protrusion for engaging with the lock arm of the lock member. The release button is operable to deflect the lock arm by the actuating protrusion for disengaging the pawl from the corresponding part of the mating connector.

Said means for locking and releasing are widely used in cabled end connectors. Sometimes, said simple locking and releasing can not meet multi-function tendency of connectors. We hope to design a new locking and releasing mechanics

SUMMARY OF THE INVENTION

A cable connector assembly comprises a matable connector and a cable connector intended to mate with the matably connector. The matable connector comprises a pair of guiding boats at opposite ends thereof and each guiding boat defines a guiding groove and a locking slot in the guiding groove. The cable connector comprises a case, a connector body with a mating port exposing to a front edge of the case and cables running through a rear edge of the case and a pair of locking members located at the case. The connector body defines a pair of guiding posts intended to be communicated in the guiding grooves of the matably connector. Each guiding post defines a first receiving groove therein. Each locking members comprises a rear end retained in the case and a front end with a locking end extending forward and received in the first receiving groove.

Other features and advantages of the present invention will become more apparent to those skilled in the art upon examination of the following drawings and detailed description of preferred embodiments, in which:

DETAILED DESCRIPTION OF THE PREFERRED EMBODIMENT

Figure 1:
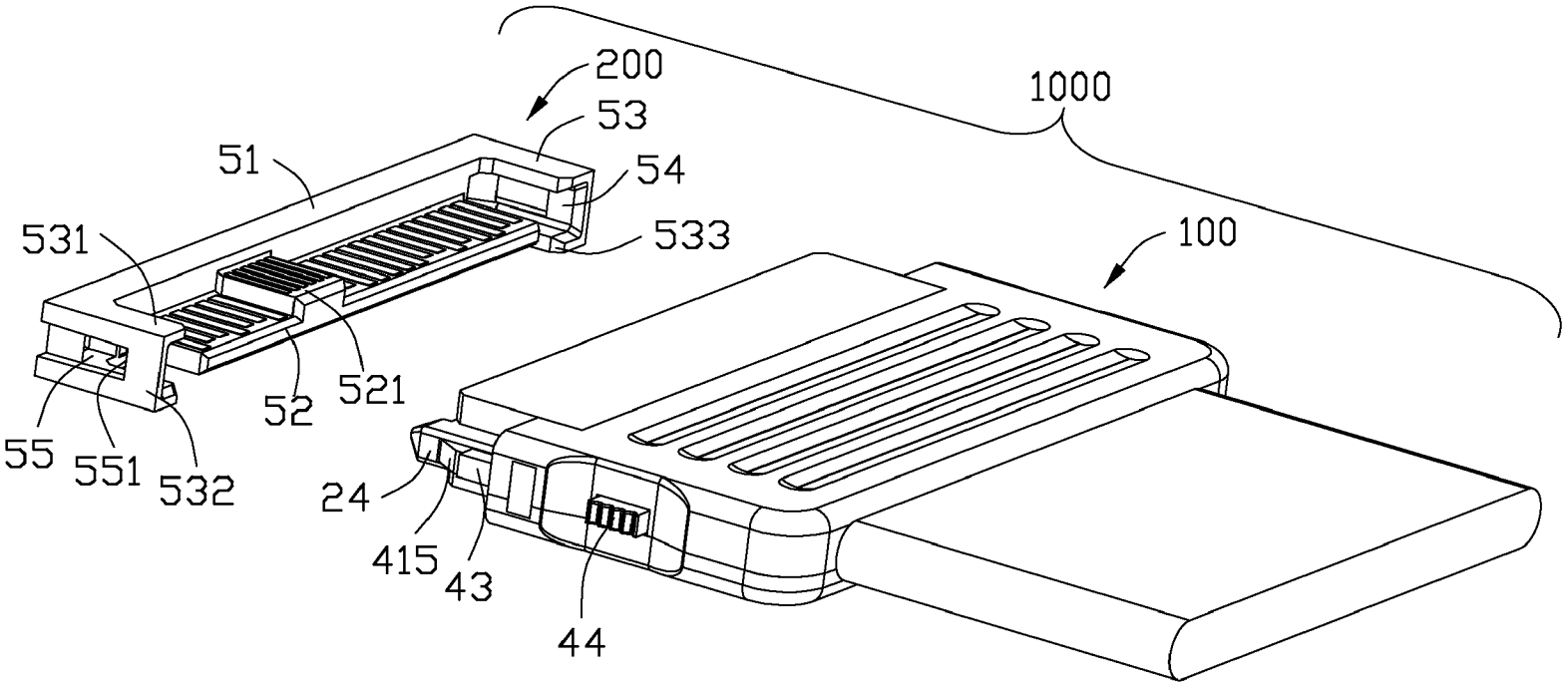
FIG. 1 is a perspective view of a cable connector assembly in accordance with a first embodiment of the present invention.
Figure 2:
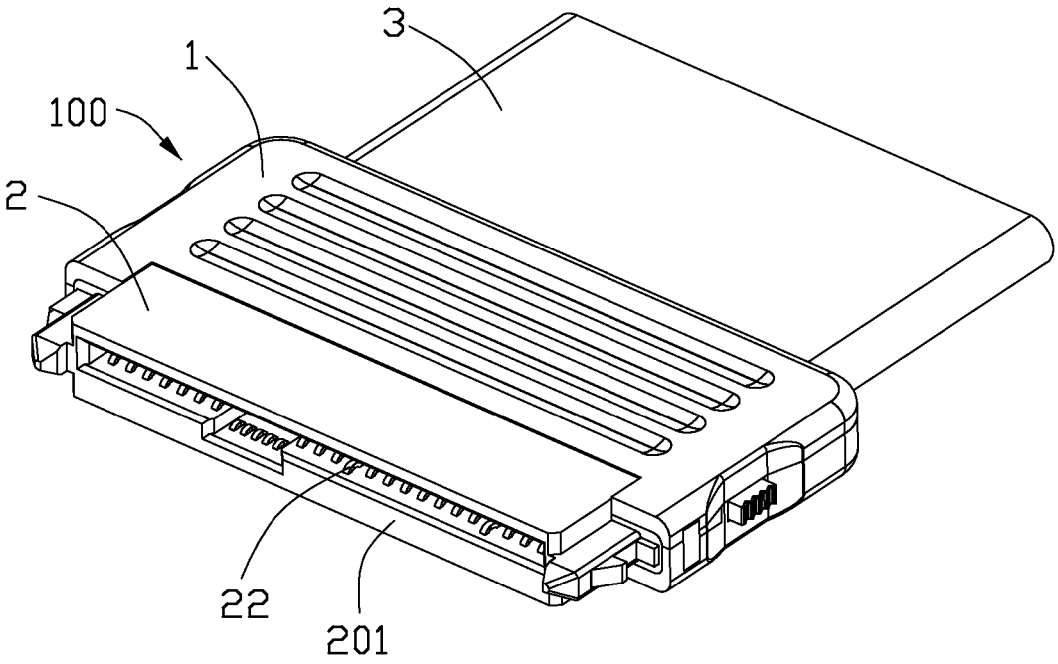
FIG. 2 is a perspective view of the cable connector shown in FIG. 1 from another view.

Further detailed description of the preferred embodiments of this present invention is set forth below along with the attached drawings.

FIG. 1 through FIG. 4 show an electrical connector assembly 1000 of a first embodiment according to the present invention, which includes a cable connector 100 and a board connector 200. The cable connector 100 includes an insulating case 1 with an upper case 11 and a lower case 12 fixed together defining a rectangular interior space 101 for receiving a connector body 2 and front ends of cables 3. The case 1 defines a pair of window openings 102 in opposite end faces for communicating a pair of button. The connector body 2 projects forwards beyond a front edge of the case to define a mating port 201 at a front portion thereof and connects with said front ends of the cable 3 by conductive contacts 22 therein at a rear portion thereof. The upper and lower case 11, 12 each includes a top wall 11*a*/12*a*, two end walls 11*b*/12*b* and a rear wall 12*c*, thereby constituting said interior space 101 commonly. The window openings 102 are disposed the end walls 12*b* of the lower case 12.

Figure 3:
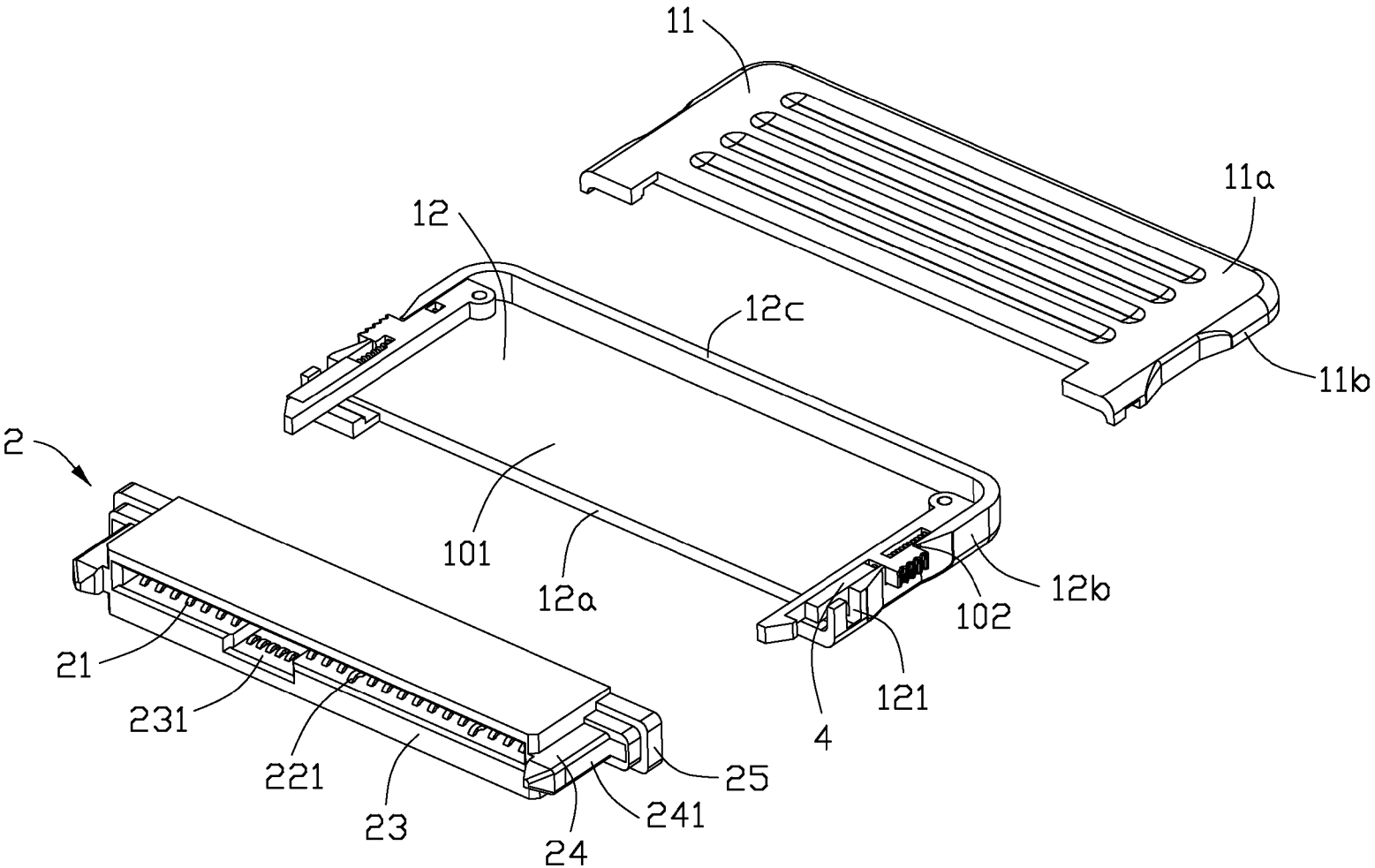
FIG. 3 is an exploding perspective view of the cable connector shown in FIG. 1 without cables.
Figure 4:
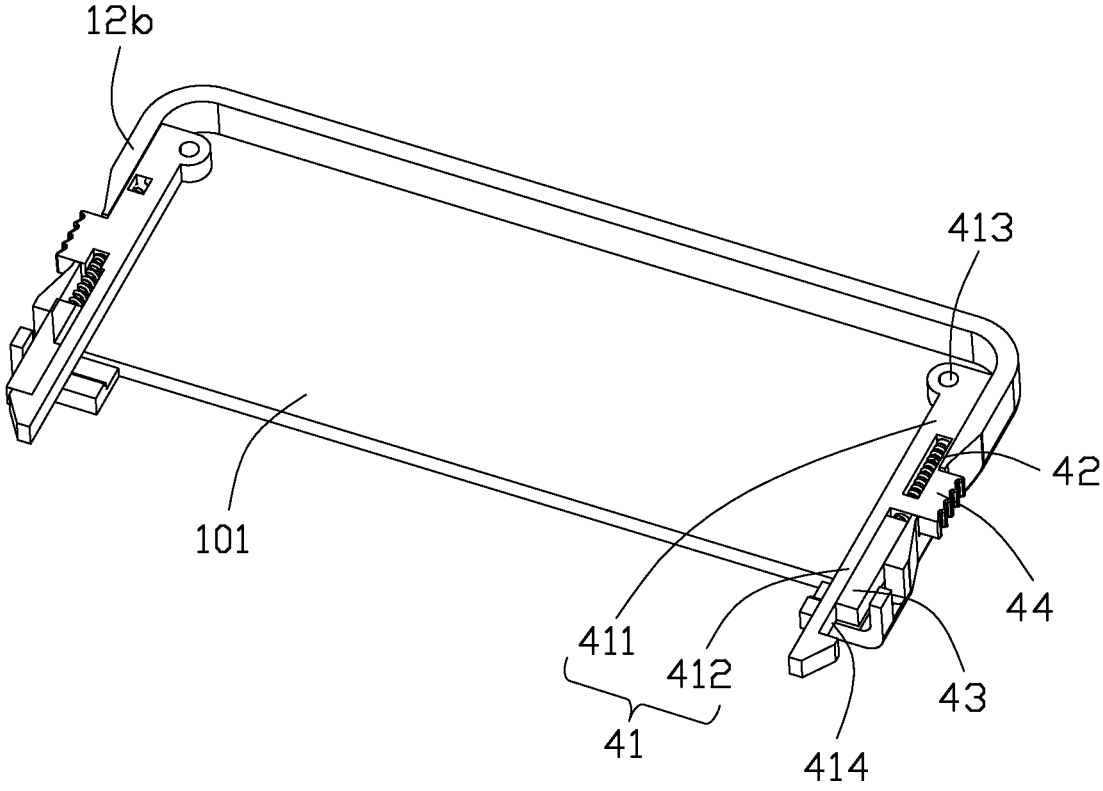
FIG. 4 is a perspective view of the lower case and locking member shown in FIG. 3.

Referring to FIGS. 3 and 4, the connector body 2 is of rectangular shape and defines a mating slot 21 extending forwards and surrounding by side walls 23. Contacting portions 221 of the plurality of contacts 22 project in the mating slot 21 along two opposite inner side faces 23 of the mating slot. One inner side face 23 further defines a channel-shape recess 231 for engagement of a rib 521 (labeled in FIG. 1) of board connector, which provides an anti-mismating function. The recess 231 is also loaded with the contacts. A pair of guiding posts 24 integrally disposed at two ends of the connector body, which have taper free ends. Each guiding post 24 defines a first receiving groove 241 therein, which opens outwards and rearwards. The first receiving grooves do not run through the free ends of the guiding posts so as to define a facing-rearwards face 2412 labeled in FIG. 5.

Figure 5:
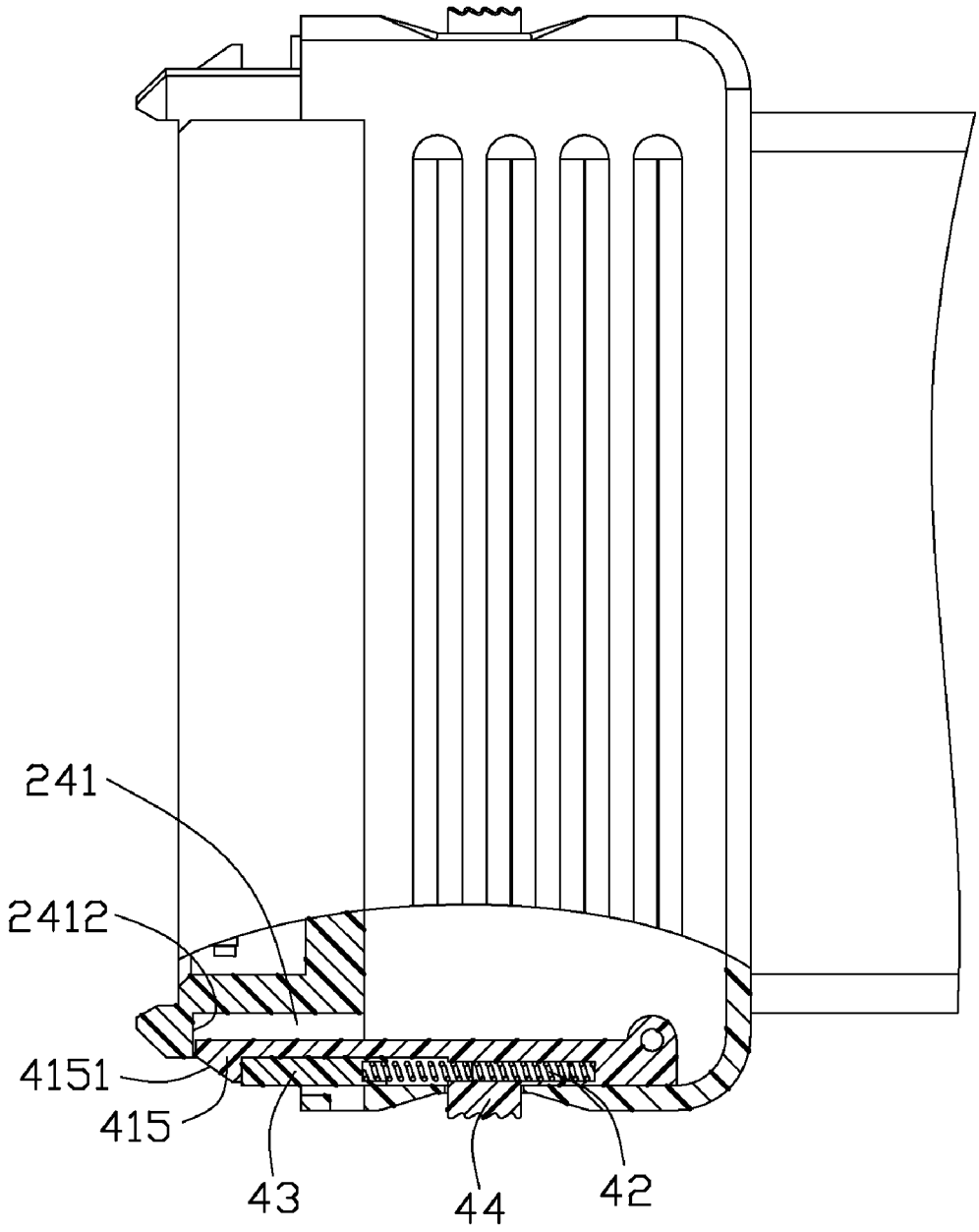
FIG. 5 is a top planar view of the cable connector, wherein partly of the upper case is cut away to shown the locking member.
Figure 6:
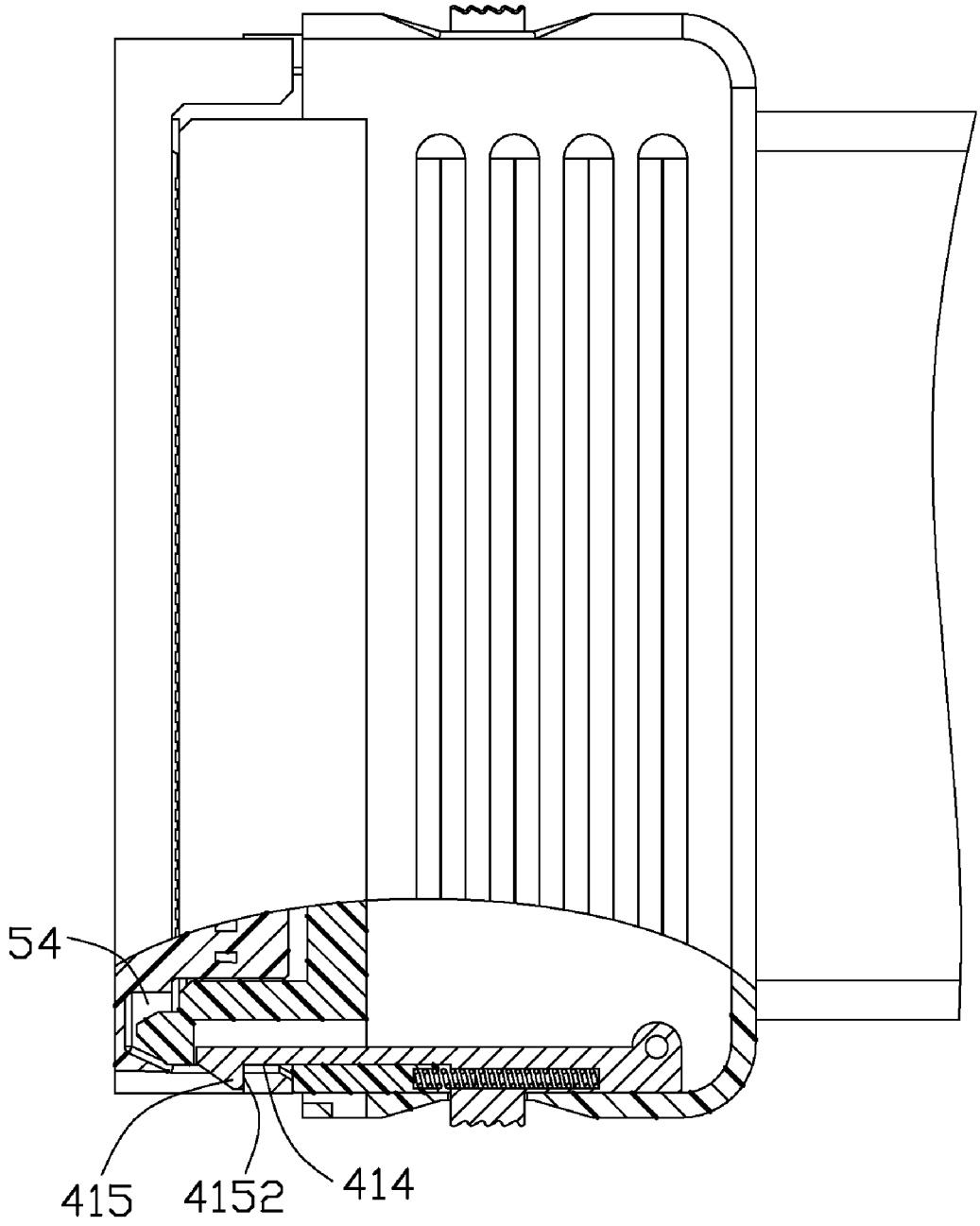
FIG. 6 is similar to FIG. 5, wherein the cable connector is inserted with the matable connector.

Referring to FIGS. 3 and 4, the locking members 4 is received in the interior space 101 and abutting against end walls 12*b* of the lower case 12, which includes a locking arm 41, a coil spring 42 and a plunger 43. The locking arm 41 has a rear portion 411 disposed in the case and a front portion 412 extending forward beyond the front edge of the case and then received in the first receiving groove of the guiding post as best shown in FIGS. 5 and 6. The rear end of locking arm is rotatably retained in the case by a retaining post 413 so that the locking portion 41 can slight rotatably inward about the retaining post 413 i.e., a fulcrum.

Combination with FIGS. 5 and 6, the locking arm 41 further defines a second receiving groove 414 opening outwards between the front end and the rear end thereof. The front end of the locking arm functions as hook locking end 415 which has a slantwise forward face 4151 thereof for guiding function and a face-rearward locking face 4152 in response to the second receiving groove. The front end of the coil spring 42 is inserted in the rear end of the plunger 43, and then the plunger and the coil spring are commonly received in the second receiving groove 414. A front end of the plunger 431 is abutting against the locking face 4152 as best shown in FIG. 5 by the forward elastic force from the coil spring 42 in a free statue without ant exterior enforce. Or the plunger is just abutting against the locking face in a condition the coil spring is just in a free status. The locking arm 41 integrally extends a lateral portion out the side face thereof, which forms a button 44 for release the locking engagement of the locking arm and the board connector. The button 42 goes through an outer surface of the case through the window opening 102 for user. The end wall defines a notch 121 labeled in FIG. 3 is for receiving retaining flange 25 at back of the guiding post of the connector body for retaining the connector body in the case.

Referring to FIG. 1, the board connector 200 has a base portion 51, a mating tongue 52 extending from the base portion and a pair of guiding boats 53 at two opposite ends of and separating from the mating tongue. The guiding boat 53 defines a guiding groove 54 opening forwards and inwards opposite to the mating tongue. The guiding boat includes three walls 531,532,533 to from said guiding groove and the vertical wall 532 perpendicular to the mating tongue further define a locking slot 55 running through a rear face thereof and do not run through the front end of the guiding boat. The locking slot defines a facing-rearwards locking face 551.

When the cable connector 100 is inserted in the board connector 200 wherein the guiding posts 24 as best shown in FIG. 6, are inserted into the guiding grooves 54 firstly, the plungers 43 are then pushed rearwards by the vertical walls 532 since the plungers project outwards the guiding posts 24 in the lateral direction perpendicular to an inserted direction of the cable connector 100 as best shown in FIG. 5. As a result, the locking ends 415 enter in the locking slots 55, the locking surfaces 4152, 551 latch with each other since a gap is remained by the rearwards moving plunger 43. When the cable connector 100 is desired to disconnect from the board connector 200, the locking arm 41 rotates inward slightly by pushing the button 44 and the locking ends 415 disconnect from the locking slots 55. Please notes, the inside faces of the locking arms 41 separate from the inside faces of the first receiving grooves with a gap G to allow an inward rotation of the locking arms.

Other type connector such as legacy SAS or SATA board connector which has a similar shape to the board connector 200 but includes less contacts and without any locking slots in the guiding boat, can not remain in place to engage with the cable connector of this present invention when the cable connector is inserted into the legacy SAS board connector. This is because without latchable engagement between the locking slots 55 and the locking ends 415 the forward-forced plungers 43 will eject the cable connector away from the legacy board connector, thus preventing permanent mating.

Figure 7:
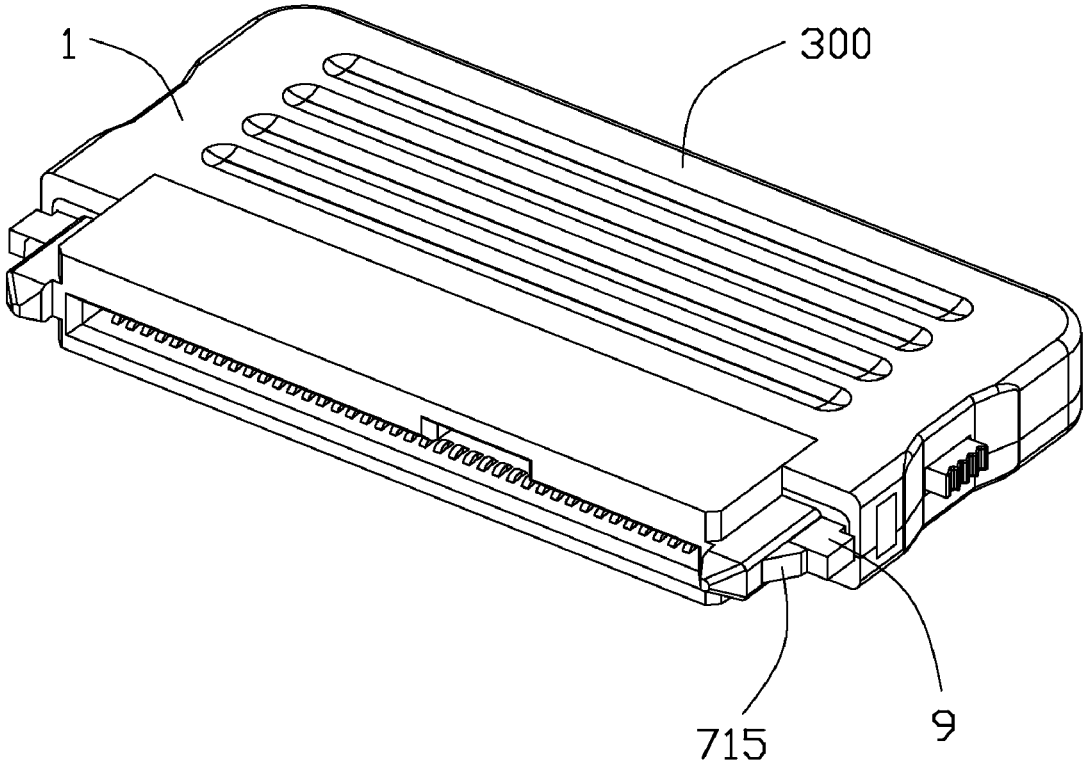
FIG. 7 is a perspective view of a cable connector in according to second embodiment of this present invention.
Figure 8:
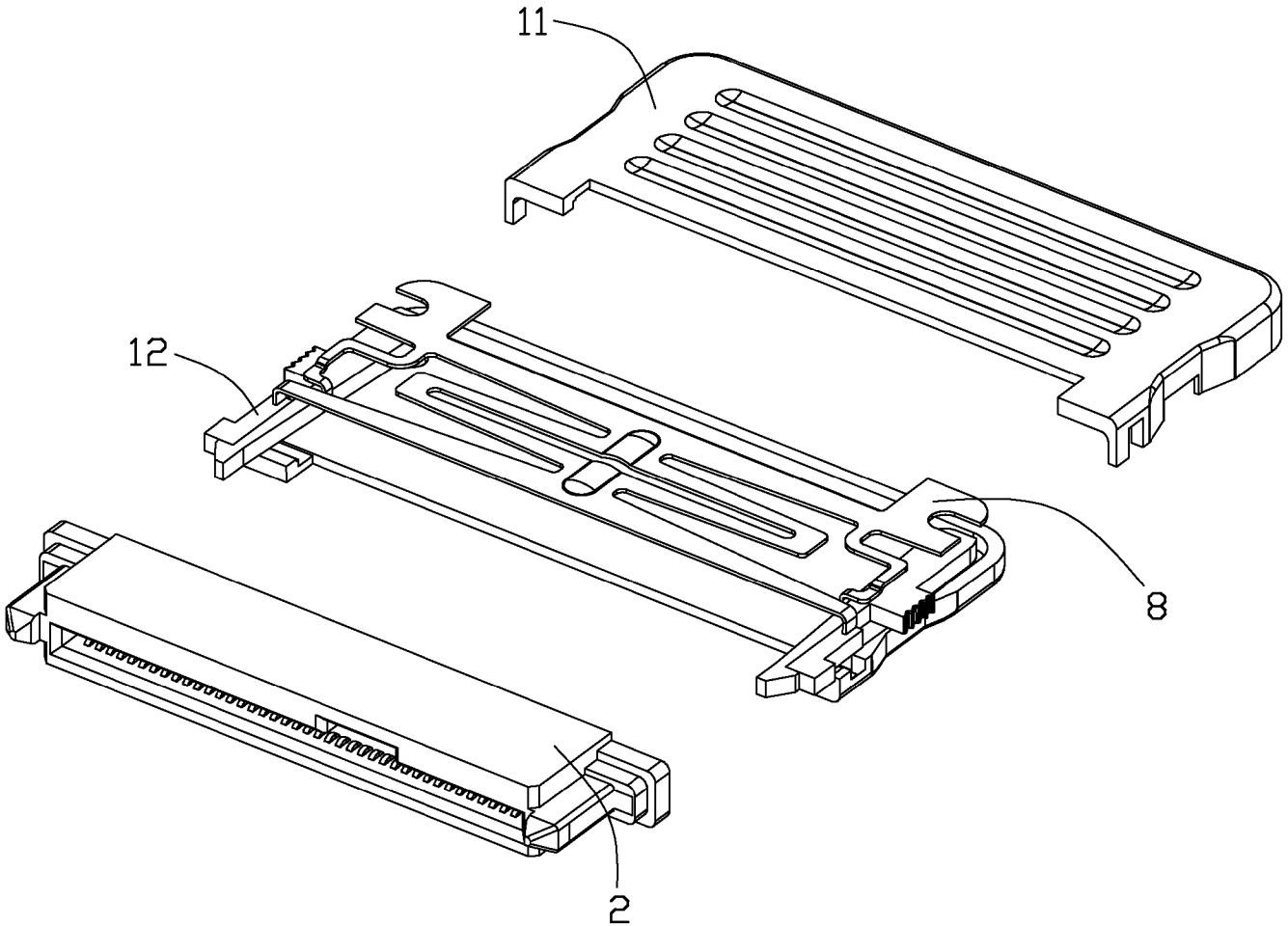
FIG. 8 is an exploding perspective view of the cable connector shown in FIG. 7.
Figure 9:
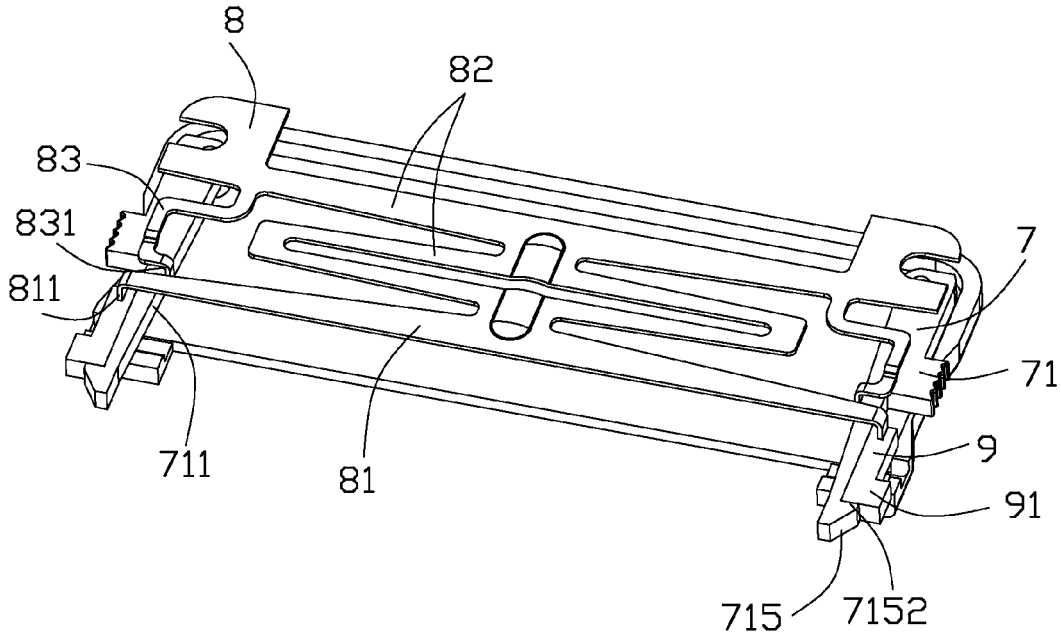
FIG. 9 is a perspective view of the lower case and locking member shown in FIG. 8.

A second embodiment is shown in FIG. 7 through FIG. 9, which has a cable connector 300 similar to the cable connector 100. Description same to the first embodiment is omitted. The locking arm 7 integrally extends outwards a button 71 at a middle portion thereof. The plunger 9 is located between a front face of the button and the face-rearwards locking face 7152 of locking end 715. A one-piece plate spring 8 is located parallel to the case 1 and includes a retention beam 81 with two distal ends 811 which bent to be retained in the pair of the plungers adjacent to a rear end of the plunger 9. The plate spring 8 further includes a plurality of elastic arms 82 substantially parallel to the retention beam 81 so than the plate spring has elastic deform in a front and rear direction (i.e., the inserted direction) perpendicular to the extending direction of the elastic arm 82. A pair of positioning arms 83 non-parallel extend from one elastic arm with two distal ends 831 abutting against the inside faces 711 of the locking arms 7. The plate spring 8 is assembled below the upper case 11 in a condition that the plunger is pressed against the locking face 7152. When the board connector 200 is inserted, the guiding seats push the plungers 7 moving rearwards so that the locking ends 715 enter in the locking slots 55. In the engagement of the cable connector and the board connector, the plate springs 8 accumulate elasticity and have a forwards-movement tendency. When the cable connector disconnects from the board connector, push the button 71 to release the locking engagement. The distal ends 831 of the position arms 83 are used for restore the button in original statue. The plungers project laterally a portion 91 at a front end thereof to enlarge an area against which the board connector 200 pushes. The plate spring can be retained in plungers or upper cover at a rear edge thereof to limit the wholly shift of the plunger.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

I claim:

1. A cable connector assembly comprising:

a matable connector comprising a pair of guiding boats at opposite ends thereof and each guiding boat defines a guiding groove and a locking slot in the guiding groove;

a cable connector intended to mate with a matable connector, the cable connector comprising:

a case, a connector body with a mating port exposing to a front edge of the case and cables running through a rear edge of the case, the connector body defining a pair of guiding posts intended to be communicated in the guiding grooves of the matably connector, each guiding post defining a first receiving groove therein;

a pair of locking members each comprising a rear end retained in the case and a front end with a locking end extending forward and received in the first receiving groove, wherein each locking member comprises a locking arm, a spring and a plunger, the locking arm defines a second receiving groove between the rear end and the front end to define a locking end and a locking face, the plungers are received in the second receiving grooves and abutting against the locking faces, the plungers are pushed rearwards by the guiding boats of the matable connector and the locking ends of the cable connector enter into the locking slots in a condition that the plungers have a forward tendency produced by the springs when the matable connector and the cable connector mate with each other.

2. The cable connector assembly as described in claim 1, wherein the plungers project outwards beyond the locking ends in a lateral direction perpendicular to an inserted direction of the cable connector.

3. The cable connector assembly as described in claim 2, wherein a rear ends of the locking arms are retained in the case and rotate inward when the button is pushed inwards.

4. The cable connector assembly as described in claim 3, wherein the spring is constituted with two coil spring and press against rear ends of the plungers.

5. The cable connector assembly as described in claim 4, wherein the spring is in a plate shape with a plurality of elastic arms in the lateral direction and comprises two distal ends retained in the plungers, the spring produce a forward tendency when the plungers move rearwards.

6. The cable connector assembly as described in claim 4, wherein the spring further comprises two another distal ends abutting against inside faces of the locking arms respectively to restore the button.

7. The cable connector assembly as described in claim 1, wherein the plungers are actuated forwards by the spring to eject the cable connector from any other connectors without locking slots when the cable connector is inserted into said other connector.

8. An electrical connector comprising:

a case defining an interior space opening forwards;

a connector body received in the interior space and defining a mating port exposing to a front edge of the case, the connector body defines a pair of guiding posts at two ends of the mating port, each guiding post defining a first receiving groove thereon opening outwards;

a pair of locking members located in the case and extending forward in the first receiving grooves;

wherein each locking member comprises a locking arm, a spring and a plunger, the locking member defines a second receiving groove therein and a hook end in front of the second receiving groove, the plungers are received in the second receiving groove and abut against a rear face of the hook ends in a condition the plungers are pushed rearward by a mating connector and restore by the springs.

9. The electrical connector as described in claim 8, wherein the plungers project outwards beyond the locking ends in a direction perpendicular to an inserted direction of the electrical connector.

10. An electrical cable connector for mating with a receptacle connector having locking structures thereof, comprising:

an insulative housing defining a front-to-back direction with a mating port in a front portion for insertion into a mating cavity of the receptacle connector;

a cable connected to a rear portion of the housing;

a pair of locking members located around two opposite lengthwise ends of the housing perpendicular to said front-to-back direction, each of said locking members defining a locking end for latchable engagement with the receptacle connector and being deflectable in a direction perpendicular to said front-to-back direction; and a pair of plungers located, in the front-to-back direction, behind the locking ends of the pair of locking members, respectively, a forward force being imposed upon each of said plungers by a spring device; whereby during mating, said plunger may constantly urge the receptacle connector to move away from the cable connector while the locking end locks to the locking structure for maintaining reliable mating between the cable connector and the receptacle connector.

11. The electrical cable connector as claimed in claim 10, wherein a pair of guiding posts are unitarily formed on said two opposite lengthwise ends, and the locking members are respectively located around the corresponding guiding posts, with each corresponding locking end located behind a tip of the corresponding guiding post in said front-to-back direction while laterally projecting in said direction beyond the corresponding guiding post for locking to the locking structure of the receptacle connector.

12. The electrical cable connector as claimed in claim 10, wherein said plunger is aligned with the locking end in the front-to-back direction, and said plunger is moveable along the front-to-back direction with regard to the receptacle connector for not interfering with the receptacle connector during mating.

13. The electrical cable connector as claimed in claim 10, wherein said guiding posts defining a pair of receiving spaces respectively outwardly and communicating with an exterior in said direction, and said pair of locking members are received in the corresponding receiving grooves, respectively.

14. The electrical cable connector as claimed in claim 10, wherein the pair of locking members are equipped with corresponding respective pressing buttons exposed to the exterior for operation in the direction.

15. The electrical cable connector as claimed in claim 10, wherein each of the locking members is rotatable relative to the housing.

16. The electrical cable connector as claimed in claim 10, further including a metallic plate spring to provide restoration force of deflection of the locking member in said direction.

17. The electrical cable connector as claimed in claim 16, wherein each of said locking member is further equipped with a plunger intimately located behind the locking end and projecting beyond the locking end in the direction so as to protect a rear side of the locking end when the cable connector is not mated with any other receptacle connector, and said plunger is moveable along the front-to-back direction during mating with the receptacle connector.

18. The electrical cable connector as claimed in claim 17, wherein said plate spring provides restoration force against the plunger.

* * * * *